US006081949A

United States Patent [19]

Delicia

[11] Patent Number: 6,081,949

[45] Date of Patent: Jul. 4, 2000

[54] PILLOW WITH INCORPORATED ALARM SYSTEM

[76] Inventor: Percy Delicia, 216-06 110th Ave., Queens Village, N.Y. 11429

[21] Appl. No.: 09/322,348

[22] Filed: May 28, 1999

[51] Int. Cl.[7] ..... A47G 9/00; G04B 47/00; G04B 21/00

[52] U.S. Cl. ..... 5/639; 5/904; 5/940; 368/12

[58] Field of Search ..... 5/639, 636, 940, 5/904; 368/12

[56] References Cited

U.S. PATENT DOCUMENTS

| | | | |
|---|---|---|---|
| 4,538,142 | 8/1985 | Hamilton et al. | 5/940 |
| 5,072,429 | 12/1991 | Mair | 5/639 |
| 5,089,998 | 2/1992 | Rund | 368/72 |
| 5,144,600 | 9/1992 | Cheng | 5/940 |
| 5,737,787 | 4/1998 | Iozef | 5/639 |
| 5,764,153 | 6/1998 | Vedaa | 5/940 |
| 5,813,065 | 9/1998 | Tinhorn | 5/636 |

*Primary Examiner*—Alexander Grosz
*Attorney, Agent, or Firm*—Goldstein & Canino

[57] ABSTRACT

A pillow with incorporated alarm system including a cover portion defined by a front panel and a back panel. The front panel and the back panel are secured together along an outer periphery thereof. The cover portion contains padded material interiorly thereof. An alarm clock is disposed within the interior of the cover portion. A plurality of pressure sensors are disposed within the interior of the cover portion in a spaced relationship. Each of the sensors are in communication with the alarm clock whereby a lack of pressure will subsequently deactivate the alarm clock when activated.

7 Claims, 2 Drawing Sheets

PILLOW WITH INCORPORATED ALARM SYSTEM

BACKGROUND OF THE INVENTION

The present invention relates to a pillow with incorporated alarm system and more particularly pertains to alerting a sleeping person that a time has arrived for them to awaken and providing for deactivation of thereof.

Most people utilize alarm clocks in order to awaken them at a predetermined time during the day. These alarm clocks are generally positioned on a night stand or the like adjacent to a ben that the person is sleeping in. Most modern alarm clocks are equipped with various function buttons that allow the sleeping person to reset the alarm for a shorter period of time so that they can receive a few extra minutes of sleep. Some people are in the habit of "hitting" this rest or "sleep" button one too many times resulting in either a hurried beginning of their day or even worse, missing some critical appointment that was scheduled for the early part of their day. Most people position their alarm clocks so that they do not have to lift their head off of the pillow in order to "hit" the reset button. Because of this, the person is less likely to completely awaken on the subsequent alarm sounding.

The present invention attempts to solve the aforementioned problems by providing an alarm system that is incorporated in a pillow. The alarm system is equipped with pressure sensors that will only deactivate the alarm when the head is removed from the pillow thereby beginning the awakening process. Once partially awake, the person will realize their schedule for the day and the necessity of completely awakening.

The use of alarm systems is known in the prior art. More specifically, alarm systems heretofore devised and utilized for the purpose of awaking sleeping persons are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,072,429 to Mair discloses an electronic wake up system consisting of an alarm device encased in a soft cloth pillow. The Mair device does not discloses means to stop the alarm from sounding by removing pressure from the pillow. U.S. Pat. No. 5,144,600 to Cheng discloses a device that transmits vibrations through a pillow to awaken a sleeping individual. U.S. Pat. No. 5,089,998 to Rund discloses an alarm clock that is capable of alerting the user by vibration.

While these devices fulfill their respective, particular objective and requirements, the aforementioned patents do not describe a pillow with incorporated alarm system for alerting a sleeping person that a time has arrived for them to awaken and providing for deactivation of thereof.

In this respect, the pillow with incorporated alarm system according to the present invention substantially departs from the conventional concepts and designs of the prior art, and in doing so provides an apparatus primarily developed for the purpose of alerting a sleeping person that a time has arrived for them to awaken and providing for deactivation of thereof.

Therefore, it can be appreciated that there exists a continuing need for new and improved pillow with incorporated alarm system which can be used for alerting a sleeping person that a time has arrived for them to awaken and providing for deactivation of thereof. In this regard, the present invention substantially fulfills this need.

SUMMARY OF THE INVENTION

In the view of the foregoing disadvantages inherent in the known types of alarm systems now present in the prior art, the present invention provides an improved pillow with incorporated alarm system. As such, the general purpose of the present invention, which will be described subsequently in greater detail, is to provide a new and improved pillow with incorporated alarm system and method which has all the advantages of the prior art and none of the disadvantages.

To attain this, the present invention essentially comprises a cover portion having a generally rectangular configuration defined by a front panel and a back panel. The front panel and the back panel are secured together along an outer periphery thereof. The cover portion contains padded material interiorly thereof. The front panel has an opening within a central portion thereof exposing the interior of the cover portion. The opening has a zippered closure to allow for selectively opening and closing of the opening. An alarm clock is disposed within the interior of the cover portion inwardly of the opening. The alarm clock has a display for showing a particular alarm activation time. The alarm clock has a plurality of function buttons and a manual reset button. A plurality of pressure sensors are disposed within the interior of the cover portion in a spaced relationship. Each of the sensors are in communication with the alarm clock whereby a lack of pressure will subsequently deactivate the alarm clock when activated.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pillow with incorporated alarm system which has all the advantages of the prior art alarm systems and none of the disadvantages.

It is another object of the present invention to provide a new and improved pillow with incorporated alarm system which may be easily and efficiently manufactured and marketed.

It is a further object of the present invention to provide a new and improved pillow with incorporated alarm system which is of durable and reliable construction.

An even further object of the present invention is to provide a new and improved pillow with incorporated alarm system which is susceptible of a low cost of manufacture with regard to both materials and labor, and which accordingly is then susceptible of low prices of sale to the consuming public, thereby making such a pillow with incorporated alarm system economically available to the buying public.

Even still another object of the present invention is to provide a new and improved pillow with incorporated alarm system for alerting a sleeping person that a time has arrived for them to awaken and providing for deactivation of thereof. Lastly, it is an object of the present invention to provide a new and improved pillow with incorporated alarm system including a cover portion defined by a front panel and a back panel. The front panel and the back panel are secured together along an outer periphery thereof. The cover portion contains padded material interiorly thereof. An alarm clock is disposed within the interior of the cover portion. A plurality of pressure sensors are disposed within the interior of the cover portion in a spaced relationship. Each of the sensors are in communication with the alarm clock whereby a lack of pressure will subsequently deactivate the alarm clock when activated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
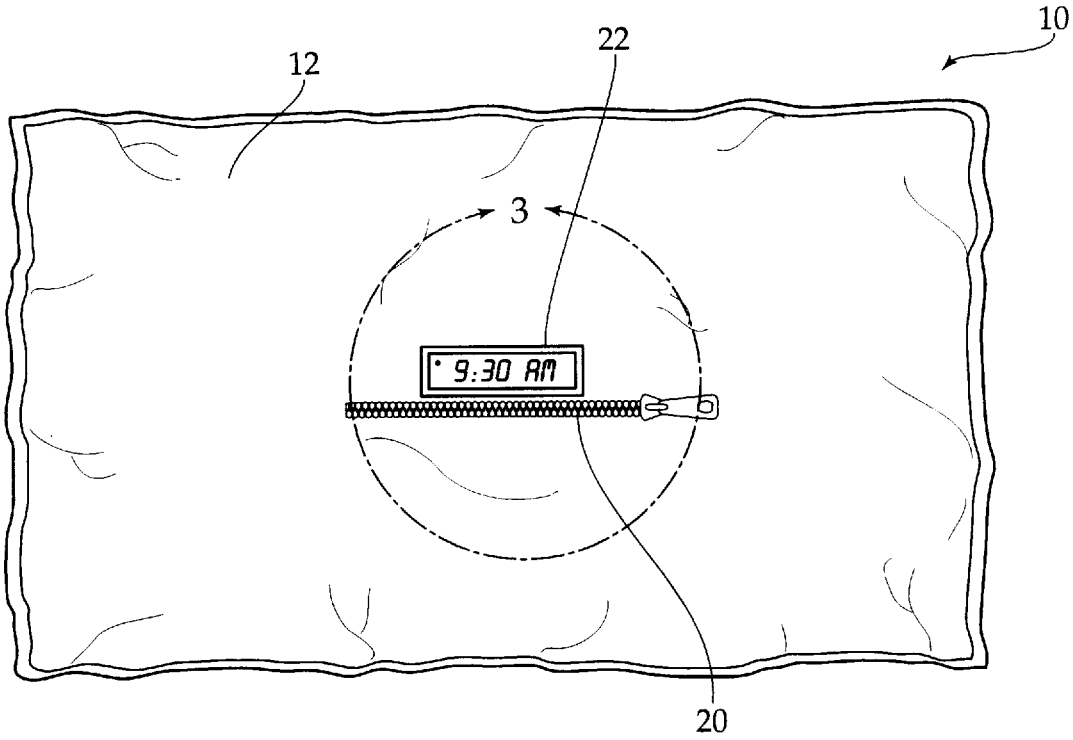
FIG. 1 is a perspective view of the preferred embodiment of the pillow with incorporated alarm system constructed in accordance with the principles of the present invention.
Figure 2:
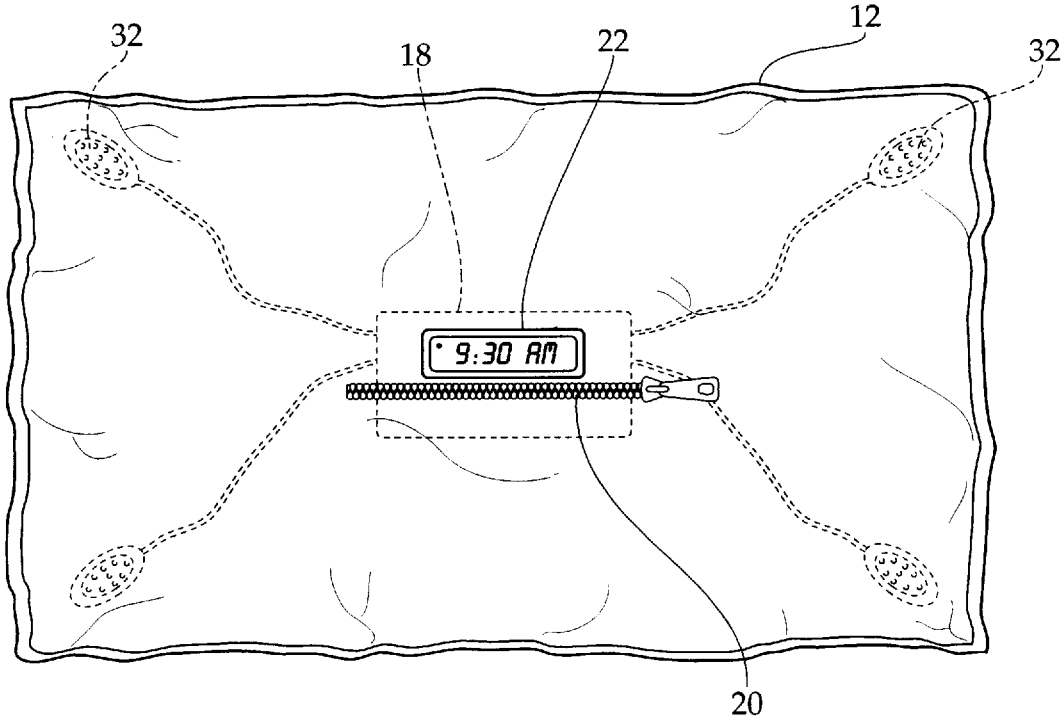
FIG. 2 is a front view of the present invention illustrating interior components thereof.
Figure 3:
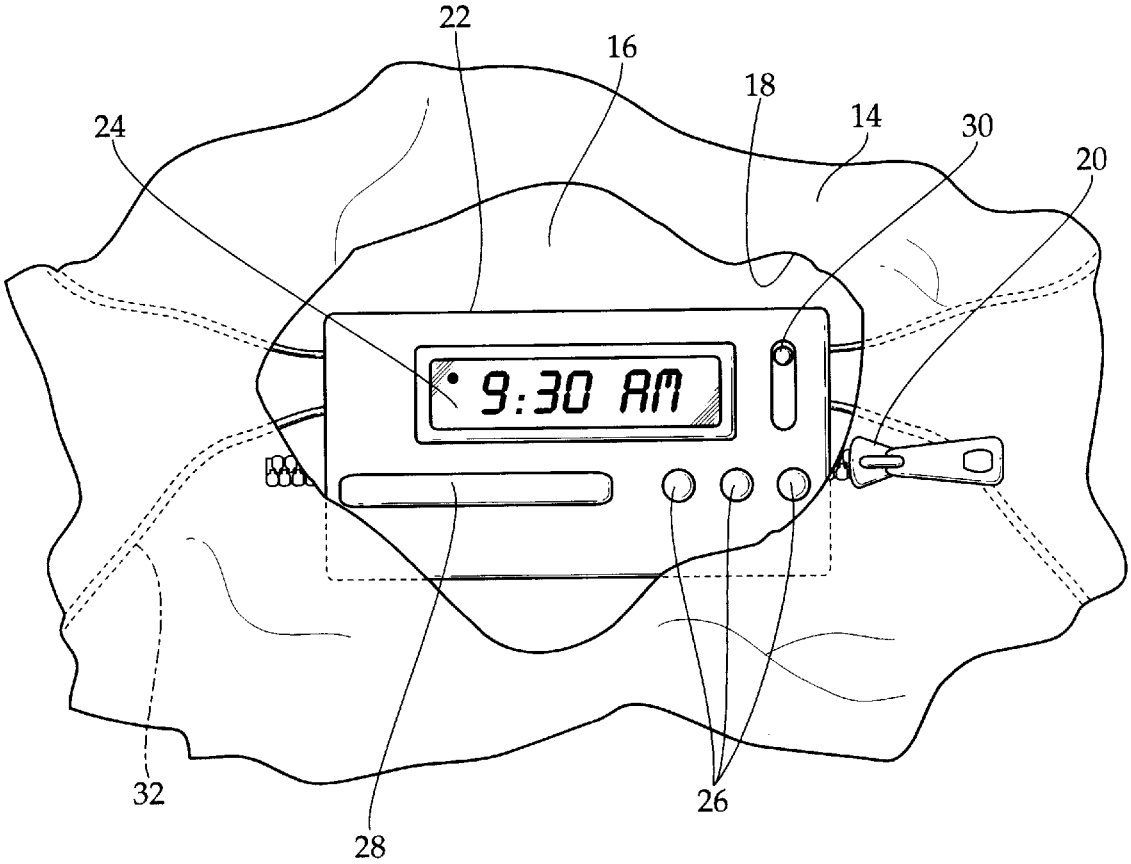
FIG. 3 is a sectional front view of the present invention as taken from circle 3 of FIG. 1.

With reference now to the drawings, and in particular, to FIGS. 1 through 3 thereof, the preferred embodiment of the new and improved pillow with incorporated alarm system embodying the principles and concepts of the present invention and generally designated by the reference number 10 will be described.

Specifically, it will be noted in the various Figures that the device relates to a pillow with incorporated alarm system for alerting a sleeping person that a time has arrived for them to awaken and providing for deactivation of thereof. In its broadest context, the device consists of a cover portion, an alarm clock, and a plurality of pressure sensors. Such components are individually configured and correlated with respect to each other so as to attain the desired objective.

The cover portion 12 has a generally rectangular configuration defined by a front panel 12 and a back panel 16. The front panel 14 and the back panel 16 are secured together along an outer periphery thereof. The cover portion 12 resembles a pillow case. The cover portion 12 contains padded material interiorly thereof. The cover portion 12 could also include means for removal of the padded material similar to a pillow case. The front panel 14 has an opening 18 within a central portion thereof exposing the interior of the cover portion 12. The opening 18 has a zippered closure 20 to allow for selectively opening and closing of the opening 18.

The alarm clock 22 is disposed within the interior of the cover portion 12 inwardly of the opening 18. The alarm clock 22 has a display 24 for showing a particular alarm activation time. The alarm clock 22 has a plurality of function buttons 26 and a manual reset button 28. The alarm clock 22 will also be equipped with an activation switch 30, which will selectively set the alarm at the activation time selected by the user.

The plurality of pressure sensors 32 are disposed within the interior of the cover portion 12 in a spaced relationship. Note FIG. 3. Each of the sensors 32 are in communication with the alarm clock 22 whereby a lack of pressure will subsequently deactivate the alarm clock 22 when activated. Each of the sensors 32 could also be equipped so as to provide a vibrating action in association with activation of the alarm so as to further facilitate the wakening of the user.

In use, the user would simply set the alarm using the function buttons 26 of the alarm clock and close the opening 18 using the zippered closure 20. The user would then place their head on the device in the normal mode of sleeping. Once the time that has been set for activation has been reached, the alarm activate and will not shut off until the user lifts their head off of the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pillow with incorporated alarm system for alerting a sleeping person that a time has arrived for them to awaken and providing for deactivation of thereof comprising, in combination:

a cover portion having a generally rectangular configuration defined by a front panel and a back panel, the front panel and the back panel being secured together along an outer periphery thereof, the cover portion containing padded material interiorly thereof, the front panel having an opening within a central portion thereof exposing the interior of the cover portion, the opening having a zippered closure to allow for selectively opening and closing of the opening;

an alarm clock disposed within the interior of the cover portion inwardly of the opening, the alarm clock having a display for showing a particular alarm activation time, the alarm clock having a plurality of function buttons and a manual reset button;

a plurality of pressure sensors disposed within the interior of the cover portion in a spaced relationship, each of the sensors being in communication with the alarm clock whereby a lack of pressure will subsequently deactivate the alarm clock when activated.

2. A pillow with incorporated alarm system for alerting a sleeping person that a time has arrived for them to awaken and providing for deactivation of thereof comprising, in combination:

a cover portion defined by a front panel and a back panel, the front panel and the back panel being secured together along an outer periphery thereof, the cover portion containing padded material interiorly thereof;

an alarm clock disposed within the interior of the cover portion;

a plurality of pressure sensors disposed within the interior of the cover portion in a spaced relationship, each of the sensors being in communication with the alarm clock whereby a lack of pressure will subsequently deactivate the alarm clock when activated.

3. The pillow with incorporated alarm system as set forth in claim 2 wherein the front panel having an opening within a central portion thereof exposing the interior of the cover portion wherein the alarm clock is disposed.

4. The pillow with incorporated alarm system as set forth in claim 3 wherein the opening has a closure means to allow for selectively opening and closing of the opening.

5. The pillow with incorporated alarm system as set forth in claim 4 wherein the closure means is a zipper.

6. The pillow with incorporated alarm system as set forth in claim 2 wherein the alarm clock has a display for showing a particular alarm activation time.

7. The pillow with incorporated alarm system as set forth in claim 2 wherein the alarm clock has a plurality of function buttons and a manual reset button.

* * * * *